US010175617B2

(12) United States Patent
Kobaru

(10) Patent No.: US 10,175,617 B2
(45) Date of Patent: Jan. 8, 2019

(54) IMAGE HEATING APPARATUS INCLUDING A BELT GUIDE MEMBER

(71) Applicant: CANON KABUSHIKI KAISHA, Tokyo (JP)

(72) Inventor: Yasunari Kobaru, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/442,471

(22) Filed: Feb. 24, 2017

(65) Prior Publication Data

US 2017/0248882 A1 Aug. 31, 2017

(30) Foreign Application Priority Data

Feb. 29, 2016 (JP) ..... 2016-037121

(51) Int. Cl.
*G03G 15/20* (2006.01)

(52) U.S. Cl.
CPC ..... *G03G 15/2028* (2013.01); *G03G 15/2053* (2013.01); *G03G 15/2017* (2013.01); *G03G 2215/2003* (2013.01); *G03G 2215/2035* (2013.01)

(58) Field of Classification Search
CPC ..... G03G 15/2017; G03G 15/2028; G03G 15/2085; G03G 2215/2003; G03G 2215/2035
See application file for complete search history.

(56) References Cited

U.S. PATENT DOCUMENTS

2013/0322937 A1* 12/2013 Suzuki ..... G03G 15/2003 399/329

FOREIGN PATENT DOCUMENTS

| | | | | |
|---|---|---|---|---|
| EP | 2741145 | A2 * | 6/2014 | ..... G03G 15/2053 |
| JP | 2006-301106 | A | 11/2006 | |
| JP | 2012-168556 | A | 9/2012 | |
| JP | 2012-252064 | A | 12/2012 | |
| JP | 2013-003503 | A | 1/2013 | |
| JP | 2013-114058 | A | 6/2013 | |

* cited by examiner

*Primary Examiner* — Joseph S Wong
(74) *Attorney, Agent, or Firm* — Canon U.S.A., Inc. IP Division

(57) ABSTRACT

A fixing apparatus that fixes an image onto a recording material includes: a belt; a nip plate contacting an inner surface of the belt; a roller configured to form a nip portion with the nip plate; a supporting member supporting the nip plate, the supporting member having a cross section in a shape of U, and supporting, with two legs, a surface of the nip plate opposite to a surface contacting the belt; and a guide member disposed on an upstream side of the nip plate and including a guide portion, wherein the recording material on which the image is formed is heated while being conveyed through the nip portion, and the image is fixed onto the recording material, and the guide member is supported by a first surface and a second surface of an upstream side leg among the two legs of the supporting member.

11 Claims, 11 Drawing Sheets

IMAGE HEATING APPARATUS INCLUDING A BELT GUIDE MEMBER

BACKGROUND OF THE INVENTION

Field of the Invention

The present embodiments relate to an image heating apparatus to be mounted on an image forming apparatus such as an electrophotographic copying machine and an electrophotographic printer.

Description of the Related Art

Conventionally, among image heating apparatuses (fixing apparatuses) used in electrophotographic-type image forming apparatuses, a belt heating type has been known (Japanese Patent Laid-Open No. 2013-114058). This apparatus includes a cylindrical fixing belt that rotates (hereinafter referred to as a belt). In addition, this apparatus includes a nip forming member, a stay, a heat source, and a belt guide member. The nip forming member is arranged inside the belt. The stay has high rigidity and presses the nip forming member. The heat source is arranged inside the stay. The belt guide member is arranged so as to cover the stay inside the belt.

A stay generally used for such an apparatus is formed of a sheet metal bent into a U shape in cross section, so that even with a thin sheet metal, the stay has rigidity against pressure applied to both ends thereof in the longitudinal direction. By bending the sheet metal, the second moment of area of the stay increases, and thus the stay obtains sufficient rigidity against the pressure direction. Therefore, it is necessary to secure the height of the stay in the pressure direction as much as possible.

The belt guide member is a resin member formed of heat-resistant resin. The belt guide member serves as a cover to protect, from the highly-heated stay, a temperature sensor, an electrical safety element, and wires thereof arranged inside the belt. The belt guide member also serves to guide the belt. With a portion of an outer peripheral surface of the belt guide member contacting an inner surface of the belt, the belt can rotate in a desired track.

Both ends of the belt guide member are pressurized against the stay by urging members, and thus brought into contact with an upper surface of the stay. In this way, a position where the belt guide member contacts the inner surface of the belt (hereinafter, referred to as a belt guide position) can be defined. Since a belt track in the vicinity of the nip forming member is particularly important for stabilizing the sheet conveyance and image quality, the belt guide member is often configured to contact the inner surface of the belt in the vicinity of the nip forming member.

In the image heating apparatus described above, however, the upper surface of the stay serving as a positional reference of the belt guide member is located away from the belt guide position. Therefore, such an image heating apparatus may have an issue that the belt guide position is easily changed by thermal expansion of the stay or belt guide member.

More specifically, in a case where the image heating apparatus is not sufficiently warmed up, such as at the time of cold start, the contact between the belt guide member and the fixing belt is weak. Therefore, the belt track is changed and the sheet conveyance becomes unstable accordingly. On the other hand, in a case where the image heating apparatus is warmed up, the contact between the belt guide member and the fixing belt becomes strong. Therefore, the rotary driving torque of the image heating apparatus tends to increase.

Therefore, it has been desired to stabilize the belt guide position in an image heating apparatus in which a heat source is arranged inside a stay and a portion of an outer peripheral surface of a belt guide member contacts an inner surface of a belt.

SUMMARY OF THE INVENTION

According to a first aspect, of the present disclosure, a fixing apparatus that fixes an image onto a recording material includes: a cylindrical belt; a long narrow nip plate contacting an inner surface of the belt; a roller configured to form a nip portion through the belt in conjunction with the nip plate; a supporting member supporting the nip plate along a longitudinal direction of the nip plate, the supporting member having a cross section in a shape of U perpendicular to the longitudinal direction of the nip plate, and supporting, with two legs forming an opening in the shape of U, a surface of the nip plate opposite to a surface contacting the belt; and a guide member disposed on an upstream side of the nip plate in a recording material conveying direction in the nip portion and including a guide portion configured to contact the inner surface of the belt, wherein the recording material on which the image is formed is heated while being conveyed through the nip portion, and the image is fixed onto the recording material, and wherein the guide member is supported by a first surface and a second surface of an upstream side leg, among the two legs of the supporting member, located on an upstream side in the recording material conveying direction, and the first surface is an end surface of the upstream side leg, and the second surface is a side surface of the upstream side leg and facing the inner surface of the belt.

According to a second aspect, of the present disclosure, a fixing apparatus that fixes an image onto a recording material includes:

a cylindrical belt; a long narrow nip plate contacting an inner surface of the belt; a roller configured to form a nip portion through the belt in conjunction with the nip plate; a supporting member supporting the nip plate along a longitudinal direction of the nip plate, the supporting member having a cross section in a shape of U perpendicular to the longitudinal direction of the nip plate, and supporting, with two legs forming an opening in the shape of U, a surface of the nip plate opposite to a surface contacting the belt; and a guide member disposed on an upstream side of the nip plate in a recording material conveying direction in the nip portion and including a guide portion configured to contact the inner surface of the belt, wherein the recording material on which the image is formed is heated while being conveyed through the nip portion, and the image is fixed onto the recording material, and wherein the guide member includes a recess, and a position of the guide member with respect to the supporting member in the recording material conveying direction is determined by fitting, among the two legs of the supporting member, an upstream side leg on an upstream side in the recording material conveying direction into the recess.

Further features will become apparent from the following description of exemplary embodiments of aspects of the present disclosure (with reference to the attached drawings).

DESCRIPTION OF THE EMBODIMENTS

[First Embodiment]

<Overview of Image Forming Apparatus>

Figure 2:
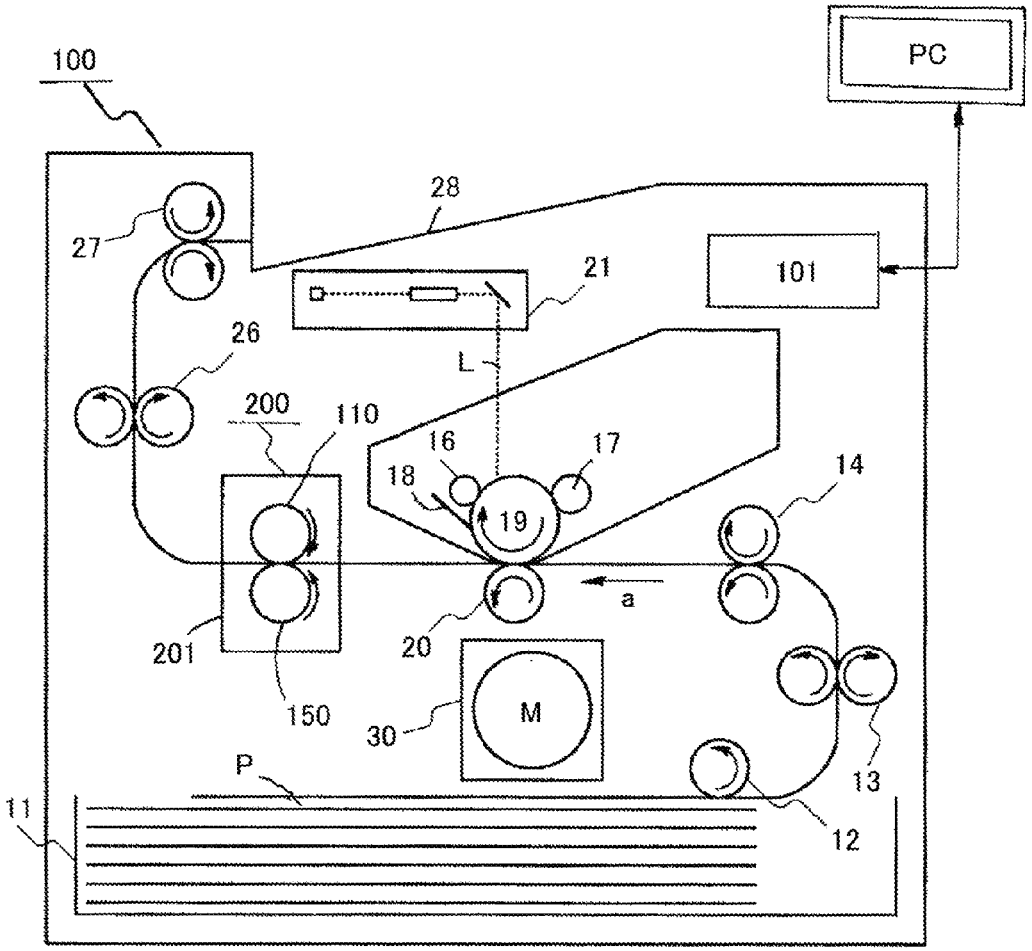
FIG. 2 is a schematic diagram of an example of an image forming apparatus.

FIG. 2 is a schematic diagram of an exemplary configuration of an image forming apparatus. An image forming apparatus 100 is a laser printer using an electrophotographic recording technique. A print signal (print job) is input from a personal computer (PC), an image reader, an external host device including a PC in a network or the like, to a control unit 101. In response, a scanner unit 21 emits a laser beam L modulated according to image information, and scans a photosensitive member 19 charged with a predetermined polarity by a charging roller 16.

The photosensitive member 19 is of a drum type and rotationally driven in the clockwise direction indicated by an arrow. An electrostatic latent image is formed on the photosensitive member 19 by the scanning exposure described above. A toner is supplied from a developing unit 17 to the electrostatic latent image, and then a toner image (toner image: developed image) is formed on the photosensitive member 19 according to the image information.

Meanwhile, recording materials (recording paper: hereinafter referred to as sheets) P stacked on a sheet supplying cassette 11 are fed one by one by a pickup roller 12 and then conveyed to a registration roller pair 14 by a conveyance roller pair 13. The sheet P is conveyed from the registration roller pair 14 to a transfer position in accordance with the timing when the toner image on the photosensitive member 19 reaches the transfer position including the photosensitive member 19 and a transfer roller 20. While the sheet P passes through the transfer position, the toner image on the photosensitive member 19 is transferred to the sheet P.

Subsequently, the sheet P is heated by an image heating apparatus (fixing apparatus) 200, and the toner image is heated and fixed on the sheet P. The sheet P bearing the fixed toner image is discharged onto a tray 28 in an upper portion of the printer by conveyance roller pairs 26 and 27.

A cleaner 18 cleans the photosensitive member 19. A motor 30 drives the image heating apparatus 200 and the like. The above-described photosensitive member 19, charging roller 16, scanner unit 21, developing unit 17, transfer roller 20, cleaner 18, and the like constitute an image forming section that forms an unfixed image on the sheet P.

<Configuration and Operation of Image Heating Apparatus>

Figure 1:
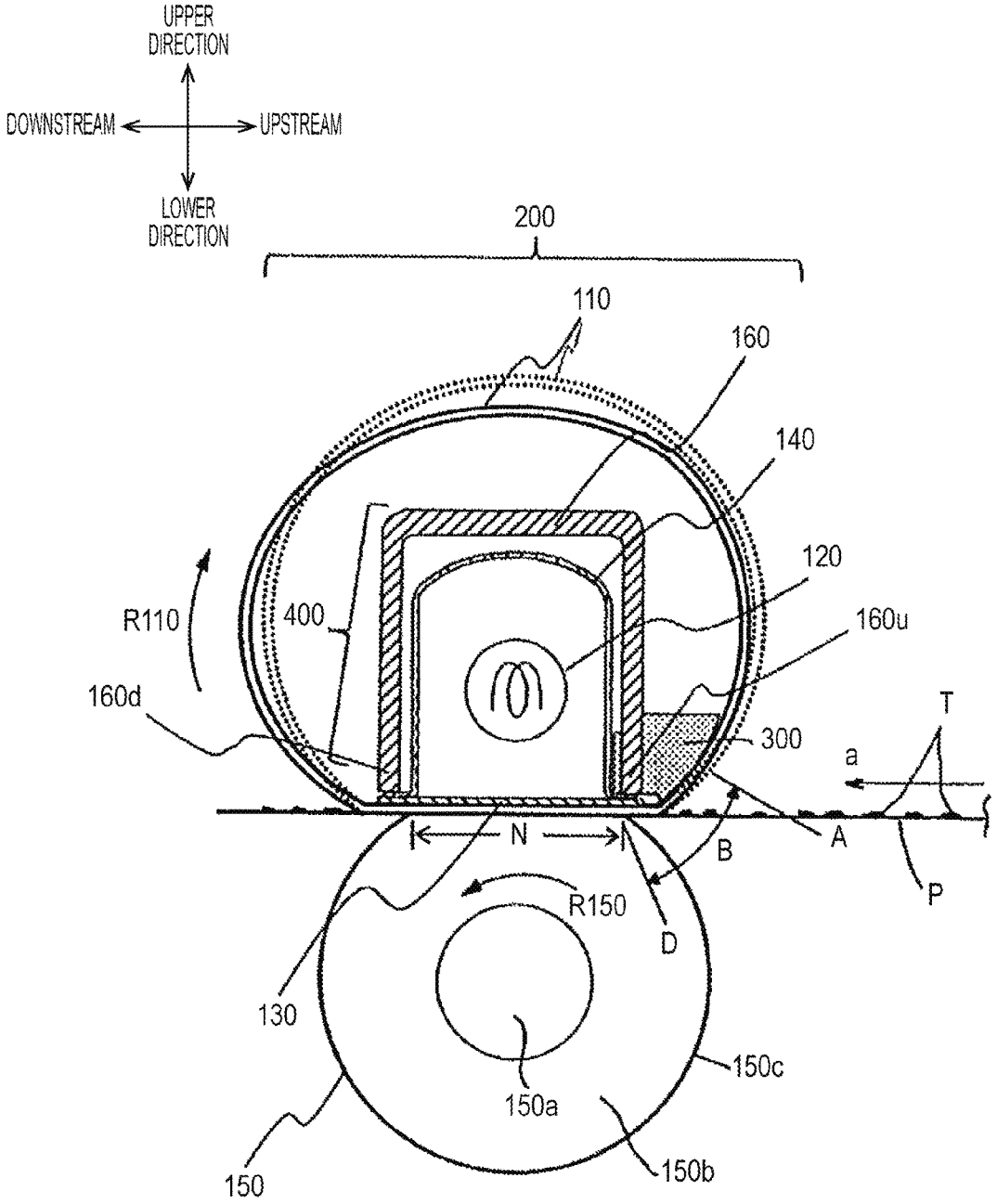
FIG. 1 is a cross-sectional view of a main part of an image heating apparatus according to a first aspect of the present disclosure.

FIG. 1 is a schematic cross-sectional view of a main part of the image heating apparatus 200. For the purpose of description hereinafter, an upstream side and a downstream side of a sheet P conveying direction (recording material conveying direction) a will be referred to as an "upstream" and a "downstream", respectively, while an upper side and a lower side of the vertical direction in the paper faces (drawings) will be referred to as an "upper direction" and a "lower direction", respectively.

The image heating apparatus 200 is of a belt heating type, and mainly includes a cylindrical fixing belt (hereinafter referred to as a belt) 110, a heating unit 400, and a pressure roller 150 as an example of a back-up member. All of these members have a width or length that can sufficiently accommodate the maximum width (dimension in a direction perpendicular to the sheet P conveying direction a) of recording materials that can be used in the image forming apparatus 100.

The belt 110 is a thin heat transfer member having heat resistance and flexibility. The belt 110 is formed of an endless (cylindrical) sleeve or film. In a free state, the belt 110 is substantially in the shape of a cylinder due to the elasticity of the belt 110 itself.

The heating unit 400 is arranged inside the belt 110, and includes a halogen heater (halogen lamp) 120 and a nip plate 130. The halogen heater 120 serves as a heat source. The nip plate 130 is an example of a nip forming member. The heating unit 400 also includes a reflection plate (reflection member) 140, a stay (supporting member) 160, and a belt guide member 300.

The halogen heater 120 is a heat source that generates radiation heat to heat the nip plate 130 and the belt 110, thereby heating a toner on the sheet P. The halogen heater 120 is arranged inside the belt 110 and positioned at a predetermined distance from inner surfaces of the reflection plate 140 and the nip plate 130.

The nip plate 130 is a long narrow plate-shaped member, and receives the radiation heat from the halogen heater 120. The nip plate 130 is arranged on an inner surface of the belt 110 so as to contact and slide on the inner surface of the belt 110. The nip plate 130 transfers the radiation heat received from the halogen heater 120 to the toner on the sheet P through the belt 110. The nip plate 130 is formed of, for example, an aluminum plate having a high heat conductivity. By painting the inner surface (top surface) of the nip plate 130 in black, the radiation heat from the halogen heater 120 can be efficiently absorbed.

The inner surface of the reflection plate 140 serves as a section that reflects the radiation heat. The reflection plate 140 is a reflection member that has a U-shaped cross section, and reflects the radiation heat generated from the halogen heater 120 toward the nip plate 130. The reflection plate 140 is positioned so as to surround the halogen heater 120, and is located at a predetermined distance from the halogen heater 120. The reflection plate 140 is formed of, for example, an aluminum plate which has high reflectivity to infrared and far infrared rays.

With the reflection plate 140, the radiation heat generated from the halogen heater 120 is collected on the nip plate 130. As a result, the radiation heat of the halogen heater 120 can be efficiently utilized, and thus the nip plate 130 and the belt 110 can be quickly heated. The reflection plate 140 is disposed such that the radiation heat generated from the halogen heater 120 is reflected toward the nip plate 130.

The stay 160 is a rigid metallic member arranged inside the belt 110, and directly abuts on the nip plate 130 or indirectly abuts on the nip plate 130 with another member interposed therebetween. The stay 160 according to an embodiment of the present aspect is a horizontally long member having rigidity by bending a sheet metal such as iron into a U shape in cross section perpendicular to the longitudinal direction of the nip plate 130. The stay 160 is arranged so as to cover the reflection plate 140. Two legs forming a U-shaped opening support the nip plate 130 over the longitudinal direction. The two legs include an upstream side leg 160*u* and a downstream side leg 160*d*. The upstream side leg 160*u* and the downstream side leg 160*d* are located on the upstream side and the downstream side of the nip plate 130, respectively, in the recording material conveying direction in a nip N. The nip plate 130 is supported by the upstream side leg 160*u* and the downstream side leg 160*d* through respective legs (bent portions) of the reflection plate 140. With such a configuration, heat of the heated nip plate 130 is transferred to the stay 160 through the reflection plate 140 having high heat conductivity, whereby the temperature of the stay 160 increases approximately to the same level as the temperature of the nip plate 130.

The belt guide member 300 is a horizontally long resin member formed of heat-resistant resin such as a liquid crystal polymer. While the fixing belt is being driven (the belt 110 is rotating), a portion of an outer peripheral surface of the belt guide member 300 comes into contact with the inner surface of the belt 110, and guides a portion of the belt 110 on the upstream side of the nip plate 130 to the nip N, which will be described later.

Figure 3:
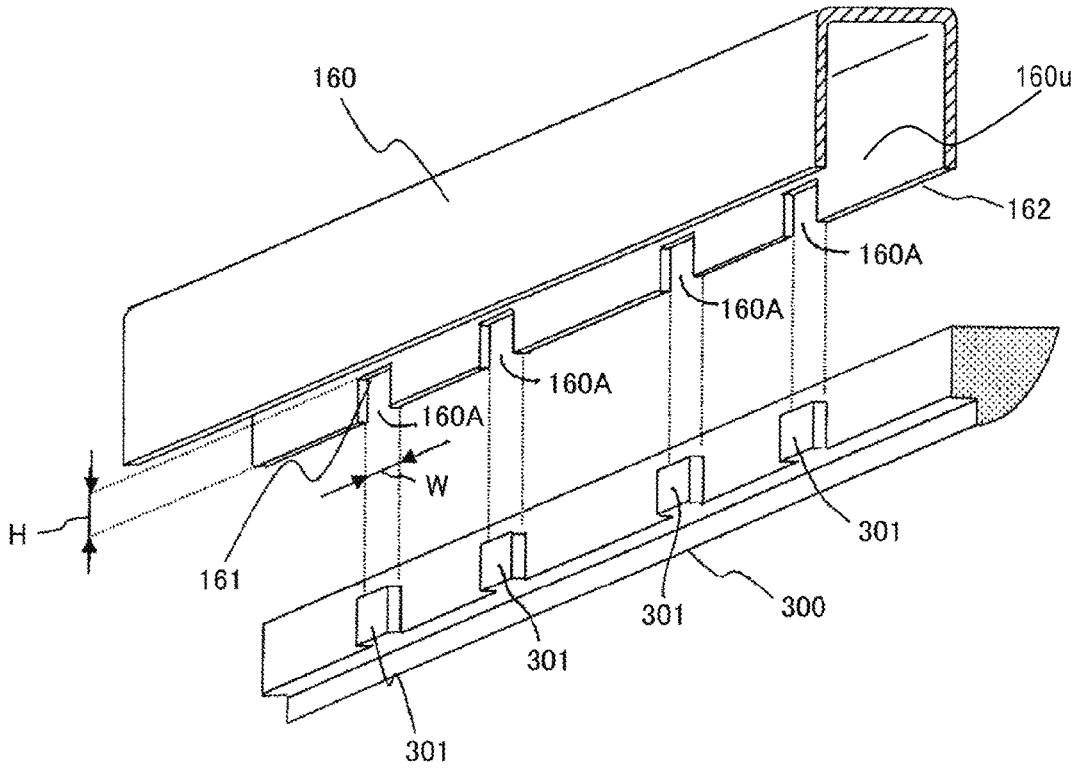
FIG. 3 is a perspective view illustrating a positional relationship between a belt guide member and a stay of the image heating apparatus.

FIG. 3 is a perspective view illustrating a positional relationship between the stay 160 and the belt guide member 300 in the longitudinal direction when viewed from the nip. A plurality of cut-out portions (recesses) 160A is formed in the upstream side leg 160*u* of the U-shaped stay 160. The cut-out portions 160A serve as supporting portions that are engaged with (fit into) respective fitting portions 301. The plurality of fitting portions 301 serves as supported portions of the belt guide member 300. The upstream side leg 160*u* includes thickness surfaces (end surfaces) 162 and thickness surfaces (end surfaces) 161. The thickness surfaces 162 support the reflection plate 140 and the nip plate 130. The thickness surfaces 161 are part of the cut-out portions 160A, and serve as positional references in the height direction of the belt guide member 300.

In an embodiment of the present aspect, the belt guide member 300 includes four fitting portions 301 that serve as supported portions. The stay 160 includes four cut-out portions 160A that serve as supporting portions of the stay 160.

The belt guide member 300 includes the fitting portions 301 that correspond to a width W and a height H of each of the cut-out portions 160A of the stay 160. The position of the belt guide member 300 with respect to the stay 160 in the height direction is determined by combining the fitting portions 301 and the thickness surfaces 161 of the cut-out portions 160A of the stay 160.

The pressure roller 150 is an elastically deformable roller member (rotary member having elasticity), and includes a core metal 150*a* and a heat-resistant elastic layer 150*b*. The elastic layer 150*b* is formed in the shape of a roller concentrically disposed on an outer peripheral surface of the core metal 150*a*. Additionally, the elastic layer 150*b* can include a releasing layer 150*c* over an outer peripheral surface of the elastic layer 150*b*. One end and the other end of the core metal 150*a* of the pressure roller 150 are rotatably supported by bearings in an area between opposing side plates of an apparatus housing 201 (FIG. 2).

Above the pressure roller 150, a belt assembly with the belt 110 loosely fit onto the heating unit 400 is arranged such that the longitudinal direction thereof is parallel to the pressure roller 150. Furthermore, the belt assembly is arranged between the opposing side plates of the apparatus housing 201, and the nip plate 130 side thereof faces the pressure roller 150.

One pressure mechanism and another pressure mechanism not illustrated apply predetermined pressure to one end and the other end of the stay 160, respectively. The pressure is applied in a direction in which the nip plate 130 is, through the belt 110, pressed onto the pressure roller 150 against the elasticity of the elastic layer 150*b*. In this way, the nip N having a predetermined width is formed between the belt 110 and the pressure roller 150 in the sheet P conveying direction a.

As an alternative apparatus configuration, the nip N having the above-described predetermined width can be formed by causing a pressure mechanism to press the pressure roller 150 onto the nip plate 130 through the belt 110 against the elasticity of the elastic layer 150*b*. As another alternative apparatus configuration, the nip N having the above-described predetermined width can also be formed by causing both pressure mechanisms on the nip plate 130 side and the pressure roller 150 side to press the nip plate 130 side and the pressure roller 150 side, respectively, so that the nip plate 130 and pressure roller 150 sides are pressed against each other. In other words, the nip N is formed between the belt 110 and the pressure roller 150 against the elasticity of the pressure roller 150 by the pressure relatively applied to the stay 160 and the pressure roller 150.

A drive gear (not illustrated) is concentrically and integrally disposed on one end of the core metal 150*a* of the pressure roller 150. A driving force of the motor 30 (FIG. 2) controlled by the control unit 101 is transmitted to the drive gear via a driving force transmission mechanism (not illustrated). In response, the pressure roller 150 is, as a driving rotary member, rotationally driven at a predetermined circumferential velocity in the counterclockwise direction as indicated by an arrow R150 in FIG. 1.

A rotary force (rotary torque) acts on the belt 110 by a frictional force generated by the rotation of the pressure roller 150 in the nip N between outer surfaces of the pressure roller 150 and the belt 110. As a result, an inner peripheral surface of the belt 110 slides while closely contacting an outer surface (sliding surface) of the nip plate 130 in the nip N. In accordance with the rotation of the pressure roller 150, therefore, the belt 110 is driven to rotate in the clockwise direction indicated by an arrow R110 in FIG. 1 at the circumferential velocity substantially corresponding to that of the pressure roller 150. Lateral shifting (meandering) accompanying the rotation of the belt 110 is restricted by regulating members (terminal members: not illustrated). One regulating member is disposed at one end of the heating unit 400, while the other regulating member is disposed at the other end of the heating unit 400. The regulating members receive respective end surfaces of the belt 110 being laterally shifted.

When the halogen heater 120 receives power supply from a power supply unit (not illustrated) controlled by the control unit 101, the halogen heater 120 causes an effective heating length range to light up and emit radiation heat. The radiation heat is directly emitted to the inner surface of the nip plate 130, while being reflected off a reflecting portion of the reflection plate 140 and then being emitted to (converged at) the inner surface of the nip plate 130. As a result, the length range of the nip plate 130 corresponding to the effective heating length range of the halogen heater 120 is heated quickly. Accordingly, the heated nip plate 130 quickly heats the belt 110 closely contacting and sliding on the outer surface of the nip plate 130 in the nip N.

The heating unit 400 includes a temperature detecting member (temperature sensor: not illustrated) that detects the temperature of the nip plate 130. Detected temperature information obtained by the temperature detecting member is fed back to the control unit 101. On the basis of the detected temperature information received from the temperature detecting member, the control unit 101 controls the power to be supplied from the power supply unit to the halogen heater 120 such that the temperature of the nip plate 130 is raised to a predetermined temperature and maintained at that temperature. In this way, the temperature of the nip plate 130 is adjusted. The temperature detecting member is a known temperature sensor such as a thermister and a thermal switch. One or a plurality of temperature detecting members is arranged in the longitudinal direction of the nip plate 130.

In a state where the pressure roller 150 is rotationally driven and the nip plate 130 is heated to the predetermined temperature by the halogen heater 120 that has received the power supply, the sheet P bearing an unfixed toner image T enters the image heating apparatus 200 from the image forming section. The sheet P is then pinched and conveyed through the nip N. The toner image T and sheet P are heated and pressed by the heat of the belt 110 and nip pressure, whereby the toner image T is fixed onto the sheet P as a fixed image. The sheet P pinched and conveyed through the nip N is separated from the surface of the belt 110 by curvature at a sheet exit portion of the nip N, and then discharged and conveyed from the image heating apparatus 200.

In the image heating apparatus 200, the rotation of the belt 110 is stopped while the driving of the pressure roller 150 is stopped. In the state where the rotation of the belt 110 is stopped, a large part of the circumference of the belt 110 excluding a portion held in the nip N between the nip plate 130 and the pressure roller 150 is not tensioned, as indicated by a broken line in FIG. 1.

When the control unit 101 receives a print signal, the control unit 101 causes the image heating apparatus 200 to be in a driving state. More specifically, the control unit 101 starts applying power to the halogen heater 120, while at the same time, starting driving the pressure roller 150 rotationally. In this way, as described above, in accordance with the rotation of the pressure roller 150, the belt 110 is driven to rotate in the clockwise direction indicated by the arrow R110 substantially at the same circumferential velocity as that of the pressure roller 150.

While the belt 110 is rotating, a force attracting the belt 110 to the downstream side in the rotational direction of the belt 110 acts on a belt portion on the upstream side relative to the nip N in the rotational direction of the belt 110. As a result, the belt 110 contacts and slides on the portion of the outer peripheral surface of the belt guide member 300 on the upstream side relative to the nip N in the rotational direction of the belt 110, as indicated by the solid line in FIG. 1.

Consequently, the belt 110 in an area B between a starting point A and a sheet entrance portion D in cross section is tensioned. The starting point A is a portion where the belt 110 starts slidingly contacting the belt guide member 300. The sheet entrance portion D is a portion of the nip N from which the sheet P enters. In this way, partial deformation of the belt 110 does not occur at the sheet entrance portion D of the nip N. As a result, the formation of wrinkles due to deformation of the sheet P closely contacting the belt 110 and penetrating (entering) the nip N is reduced. Furthermore, the deterioration of the image quality due to disturbance of the toner image T on the sheet P is also suppressed.

Figure 4:
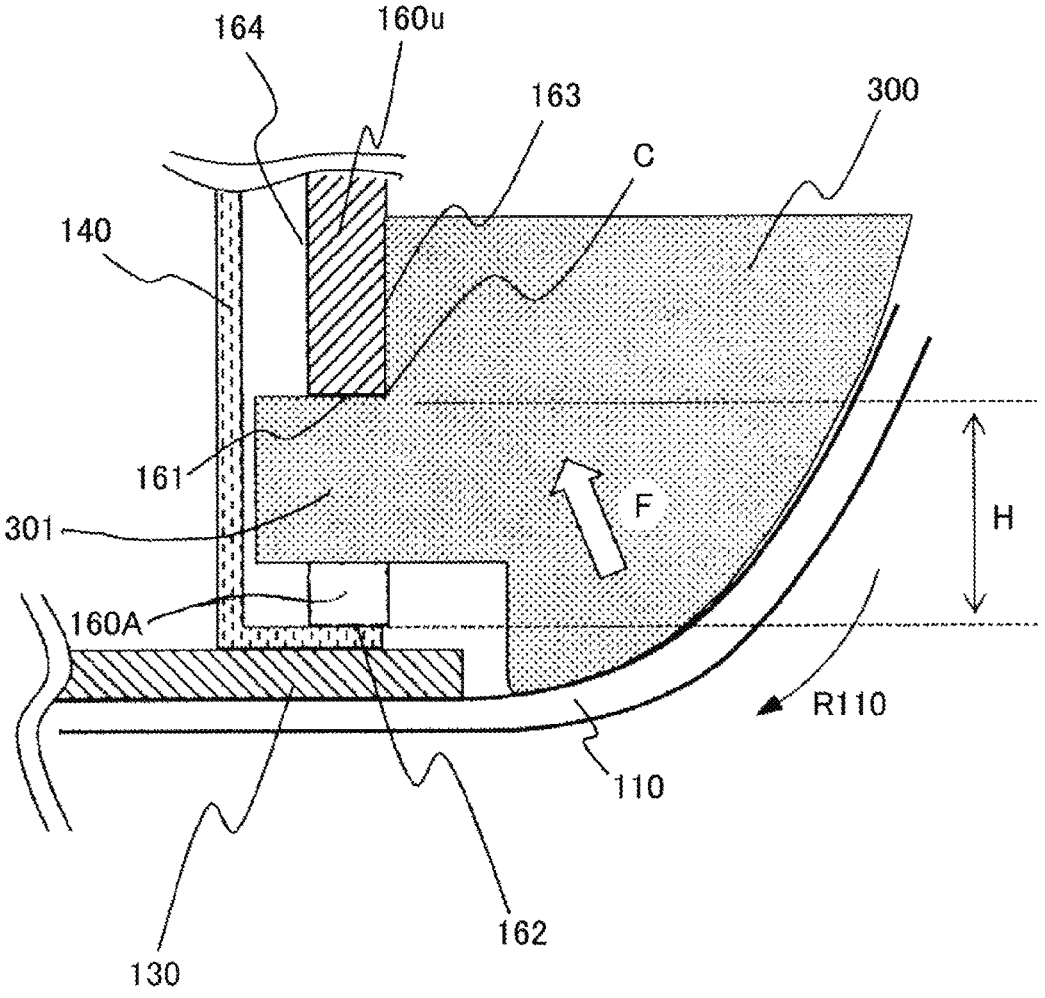
FIG. 4 is an enlarged schematic view of the belt guide member in the vicinity of a nip.

Hereinafter, further details will be described with regard to the state where the belt guide member 300 and the belt 110 are in contact with each other, while the image heating apparatus 200 is being driven. FIG. 4 is an enlarged cross-sectional view illustrating the vicinity of the belt guide member 300 in a state where the image heating apparatus 200 is being driven. In FIG. 4, the area including the cut-out portions 160A of the stay 160 in FIG. 3 is illustrated in cross section.

As for the belt guide member 300 according to an embodiment of the present aspect, a portion of the outer peripheral surface thereof in the vicinity of the area fitting into the stay 160 is supported by contacting two surfaces of the stay 160: one is the thickness surface 161 (first surface) of the cut-out portion 160A in the upstream side leg 160*u* of the stay 160, and the other is a bent side surface (second surface) 163 on the outer side of the stay 160. The bent side surface (second surface) 163 on the outer side of the upstream side leg 160*u* of the stay 160 is a side surface facing the inner surface of the belt 110.

The following describes a positional accuracy of the belt guide member 300 with respect to the inner surface of the belt 110. As for the positional accuracy in the height direction of the belt guide member 300, the belt guide member 300 is arranged on the basis of the thickness surface 161 of the cut-out portion 160A of the upstream side leg 160*u* of the stay 160 serving as a positional reference. Therefore, even in a case where the stay 160 is heated by the halogen heater 120 and the temperature becomes high, the belt guide member 300 is little affected by thermal expansion of the stay 160.

A height H between the thickness surface 162 of the stay 160 supporting the reflection plate 140 and the thickness surface 161 of the cut-out portion 160A of the stay 160 is shorter than that of a conventional image heating apparatus in which a belt guide member is arranged with an upper surface of a stay as a positional reference. Therefore, the effect of thermal expansion of the stay 160 and the belt guide member 300 is small.

As for the positional accuracy of the belt guide member 300 in the upstream and downstream directions, the belt guide member 300 is restricted by the bent side surface 163 on the outer side of the stay 160. Therefore, the belt guide member 300 does not undergo the effect of the thermal expansion more than the thickness of the stay 160 expanded with heat.

As a result, the position of the belt guide member 300 according to an embodiment of the present aspect is stabilized, particularly in the vertical direction, compared to a conventional belt guide member that uses an upper surface of a stay as a positional reference.

The following describes a tilt (inclination) of the belt guide member 300 by a force applied from the inner surface of the belt while the image heating apparatus 200 is being driven. As described above, while the image heating apparatus 200 is being driven, the inner surface of the belt 110 on the upstream side is in contact with a portion of the belt guide member 300. Accordingly, a force F (arrow F in FIG.

4) in a direction substantially perpendicular to the track of the belt 110 acts on the belt guide member 300 from the inner surface of the belt 110.

As a result, the moment of force in the counterclockwise direction in FIG. 4 acts on the belt guide member 300, with an edge C of the stay 160 as a fulcrum. In this case, by configuring the length of the surface contacting the bent side surface 163 on the outer side of the upstream side leg 160*u* of the stay 160 to be sufficiently long in the belt guide member 300 according to an embodiment of the present aspect, it is possible to suppress the turn of the belt guide member 300 around the edge C of the stay 160 more effectively. With this configuration, the belt guide member 300 is hardly tilted (inclined) while the image heating apparatus 200 is being driven.

Figure 5A:
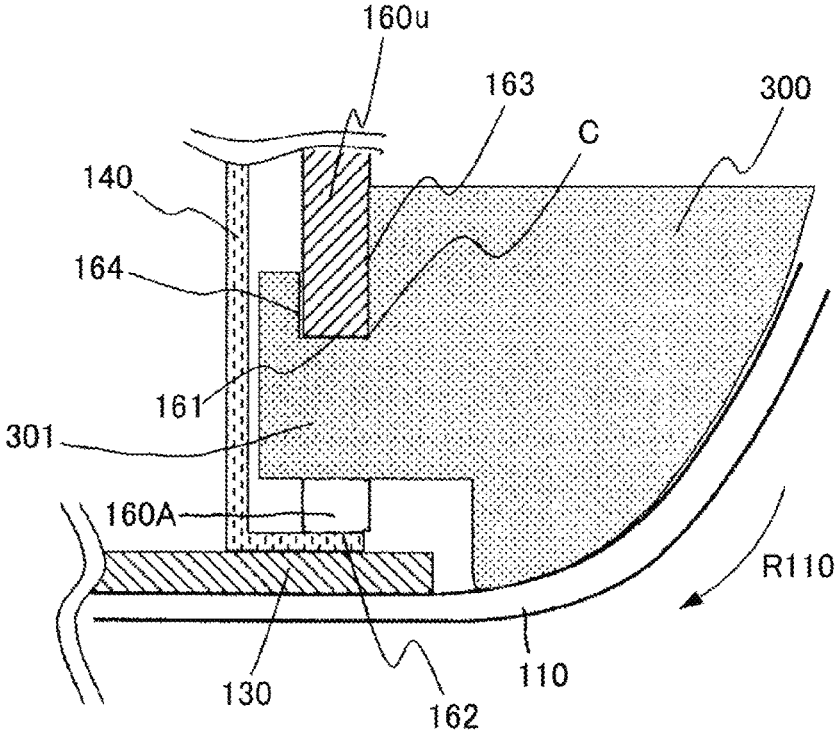
FIG. 5A is an enlarged view of a belt guide member in the vicinity of a nip according to a modification.

The shape of the position where the belt guide member 300 fits into the stay 160 is not limited to the shape described above. As illustrated in FIG. 5A, for example, a belt guide member 300 may be supported by contacting three surfaces of a stay 160. The three surfaces of the stay 160 that the belt guide member 300 contacts include a thickness surface 161 of a cut-out portion 160A of the stay 160, a bent side surface 163 on an outer side of an upstream side leg 160*u* of the stay 160, and a bent side surface 164 on an inner side of the upstream side leg 160*u* of the stay 160. The bent side surface 164 of the upstream side leg 160*u* of the stay 160 is a surface opposite to the bent side surface 163 on the outer side of the stay 160. More specifically, in the configuration illustrated in FIG. 5A, the above-described three surfaces surround a recess where the upstream side leg 160*u* of the stay 160 fits into the belt guide member 300, and the position of the belt guide member 300 with respect to the stay 160 in the recording material conveying direction and vertical direction is determined accordingly.

With the configuration where the surfaces of the belt guide member 300 supported by the stay 160 increase to three surfaces, not only does the rigidity against a force F applied from a belt 110 during the driving of an image heating apparatus 200 increase, but also the assemblability of the image heating apparatus 200 is improved since the stay 160 and the belt guide member 300 can be held while being fit to each other upon the assembly of the image heating apparatus 200.

Figure 5B:
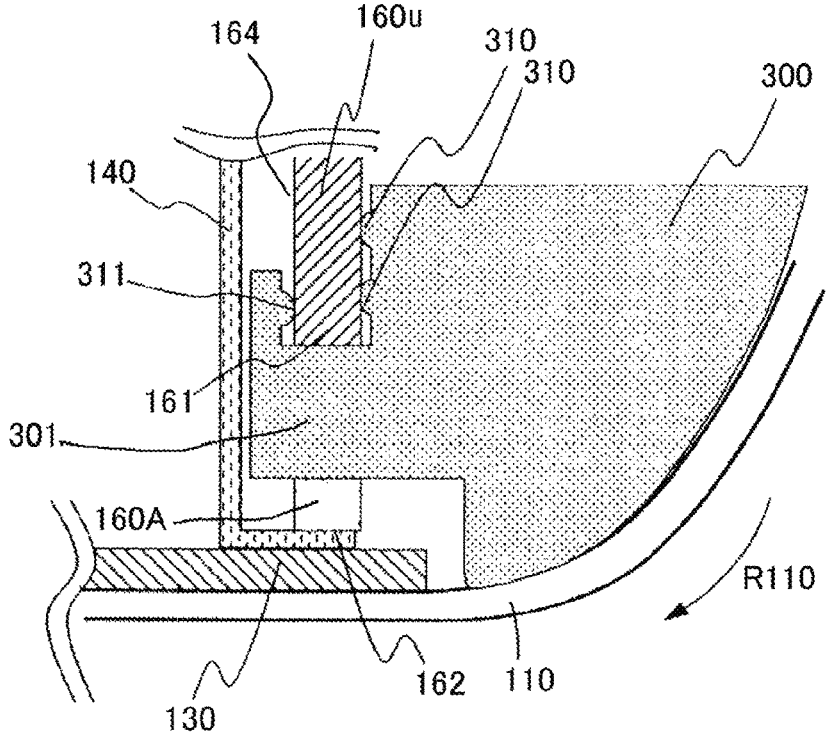
FIG. 5B is an enlarged view of a belt guide member in the vicinity of a nip according to another modification.

Furthermore, as illustrated in FIG. 5B, protrusions 310 and 311 may be disposed on surfaces of a belt guide member 300 contacting a stay 160. In this way, when the stay 160 and the belt guide member 300 are fit to each other, rattling is less likely to occur.

Figure 6:
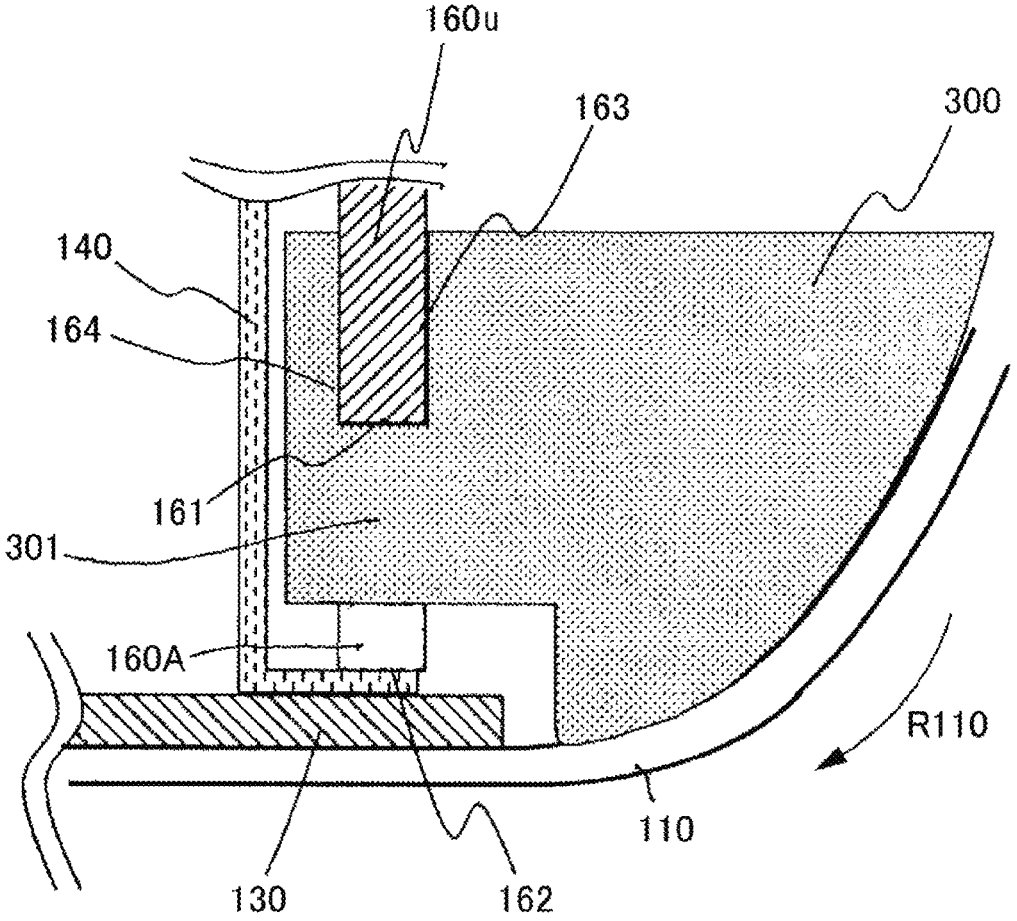
FIG. 6 is an enlarged view of a belt guide member in the vicinity of a nip according to a modification.

In a case where there are three surfaces contacting a stay 160, like a belt guide member 300 illustrated in FIG. 6, a similar effect can be attained by configuring the length of a surface contacting a bent side surface 163 on an outer side of a stay 160 and the length of a surface contacting a bent side surface 164 on an inner side of the stay 160 to be substantially the same.

Figure 10:
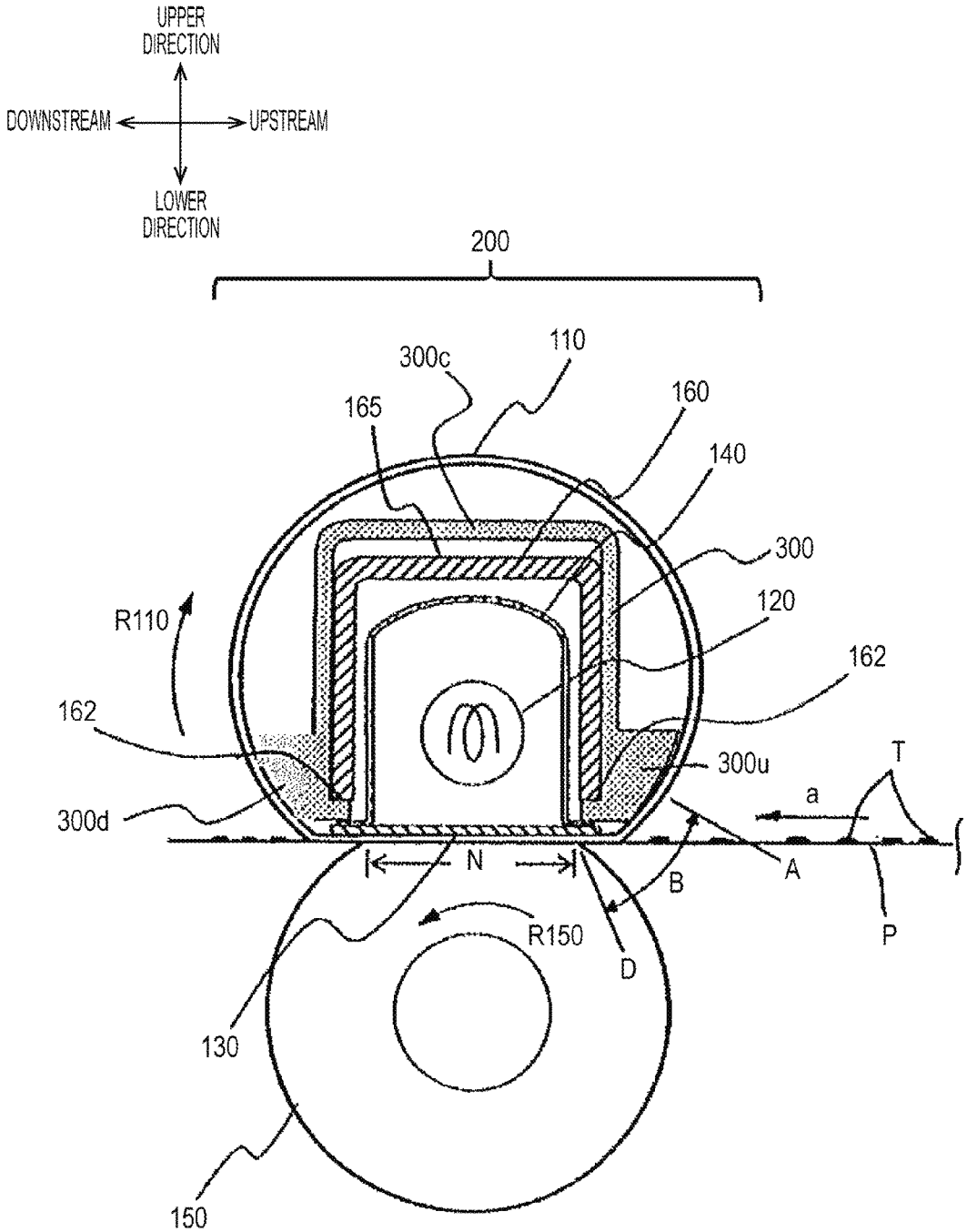
FIG. 10 is a view of an image heating apparatus according to a first modification of the first aspect of the present disclosure.
Figure 11:
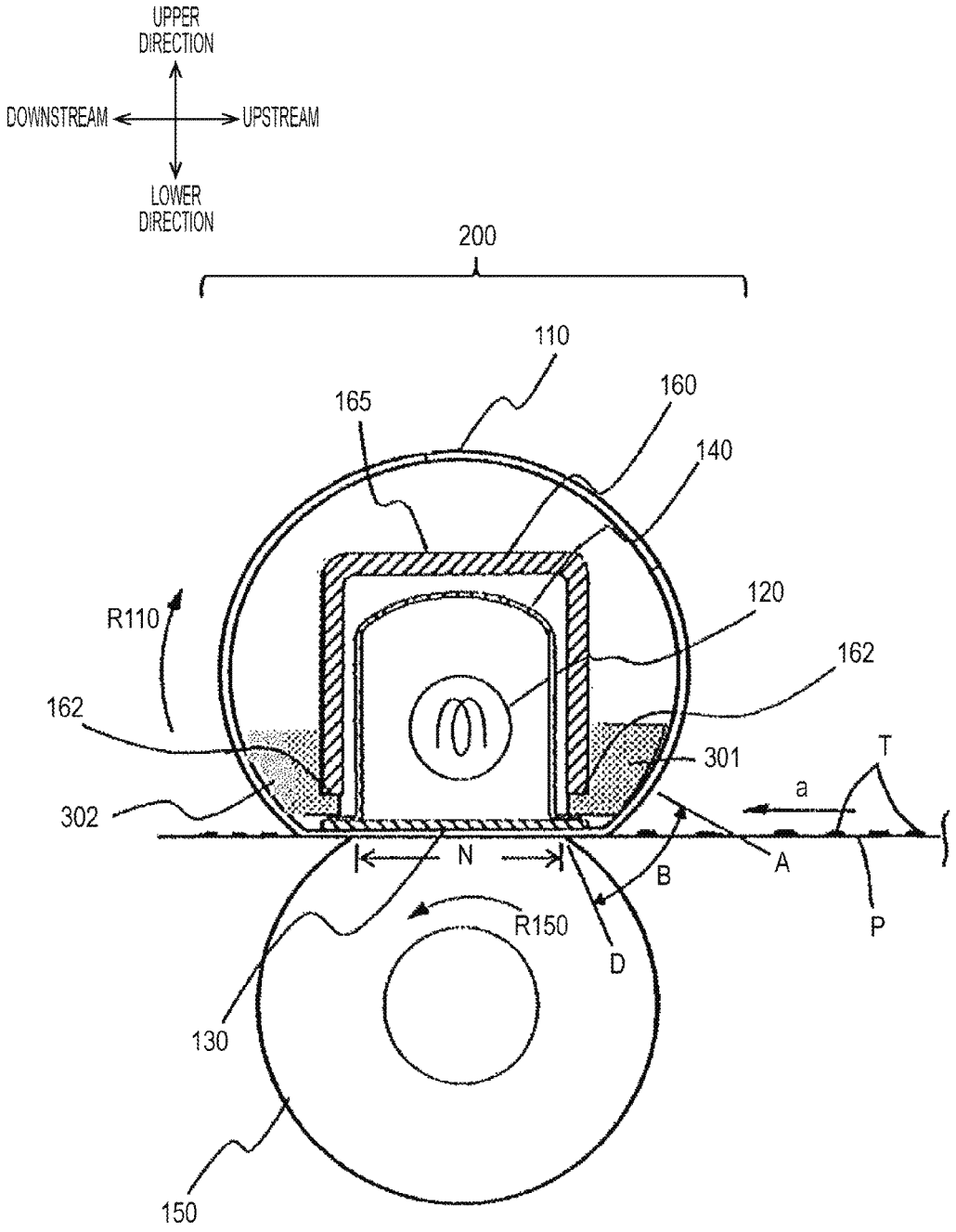
FIG. 11 is a view of an image heating apparatus according to a second modification of the first aspect of the present disclosure.

In an embodiment of the present aspect, the belt guide member is only disposed on the upstream side in the sheet P conveying direction, as described above. However, other configurations may be possible as described in a first modification and a second modification of the first aspect of the present disclosure illustrated in FIGS. 10 and 11, respectively. A difference between the first modification and the second modification is in the shape of a guide member. A belt guide member 300 according to the first modification includes a first guide portion 300*u*, a second guide portion 300*d*, and a connecting portion 300*c*. The first guide portion 300*u* is located on the upstream side of a nip plate 130. The second guide portion 300*d* is located on the downstream side of the nip plate 130. The connecting portion 300*c* connects the first guide portion 300*u* and the second guide portion 300*d*. The connecting portion 300*c* of the belt guide member 300 is disposed in an outer area opposite to a U-shaped opening of the stay 160 in cross section. In the second modification, a guide member (second guide member) 302 is disposed on the downstream side of a nip plate 130. The guide member 302 is an independent guide member disposed separately from a guide member (first guide member) 301 disposed on the upstream side of the nip plate 130.

Figure 9:
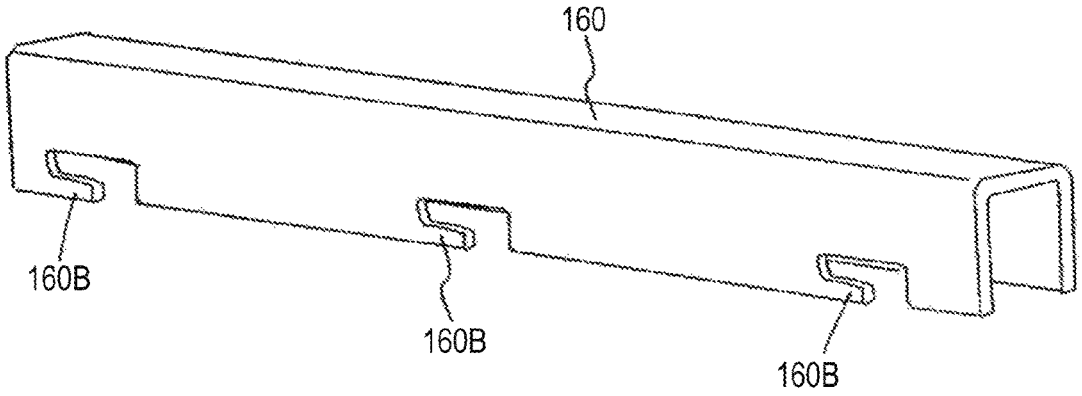
FIG. 9 is a perspective view of a stay according to a modification.

Furthermore, the method of engaging the stay 160 and the belt guide member 300 is not limited to the method described above where the stay 160 and the belt guide member 300 are engaged to each other at the cut-out portions 160A of the stay 160. As illustrated in a perspective view of the stay 160 in FIG. 9, for example, hook-shaped portions 160B may be formed on a bent end surface of a stay 160 by press work, allowing fitting portions of a belt guide member 300 to be slid into and engaged with the hook-shaped portions 160B.

In addition, a belt guide member 300 is disposed only in the vicinity of a nip, and a temperature sensor such as a thermistor, an electrical safety element such as a thermal switch, and wires thereof are accommodated in the other outer peripheral surface of the belt guide member 300. This configuration can eliminate the need of a belt guide member above the upper surface of a stay, whereby a belt with a small outer diameter can be used.

[Second Embodiment]

Figure 7:
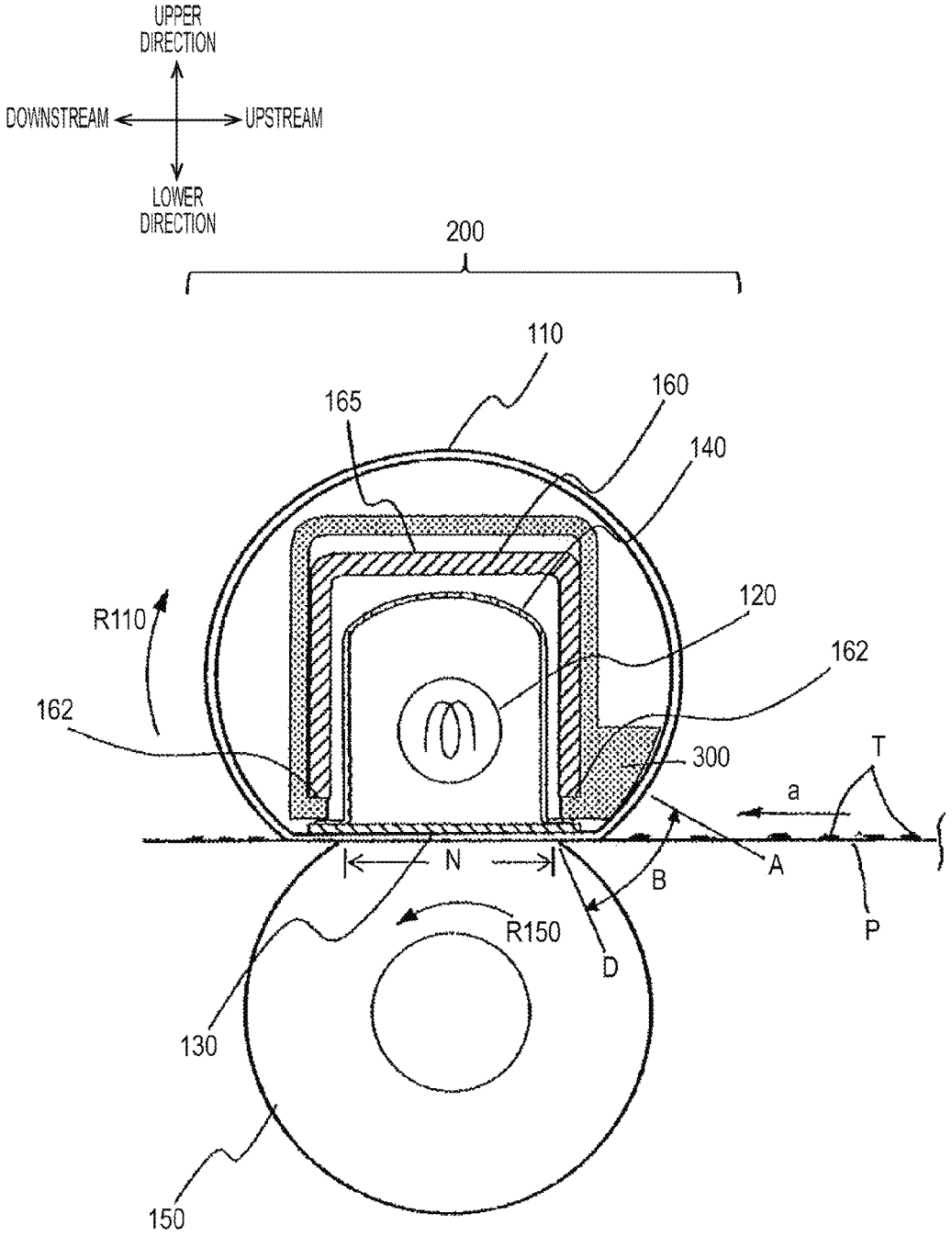
FIG. 7 is a cross-sectional view of a main part of an image heating apparatus according to a second aspect of the present disclosure.
Figure 8:
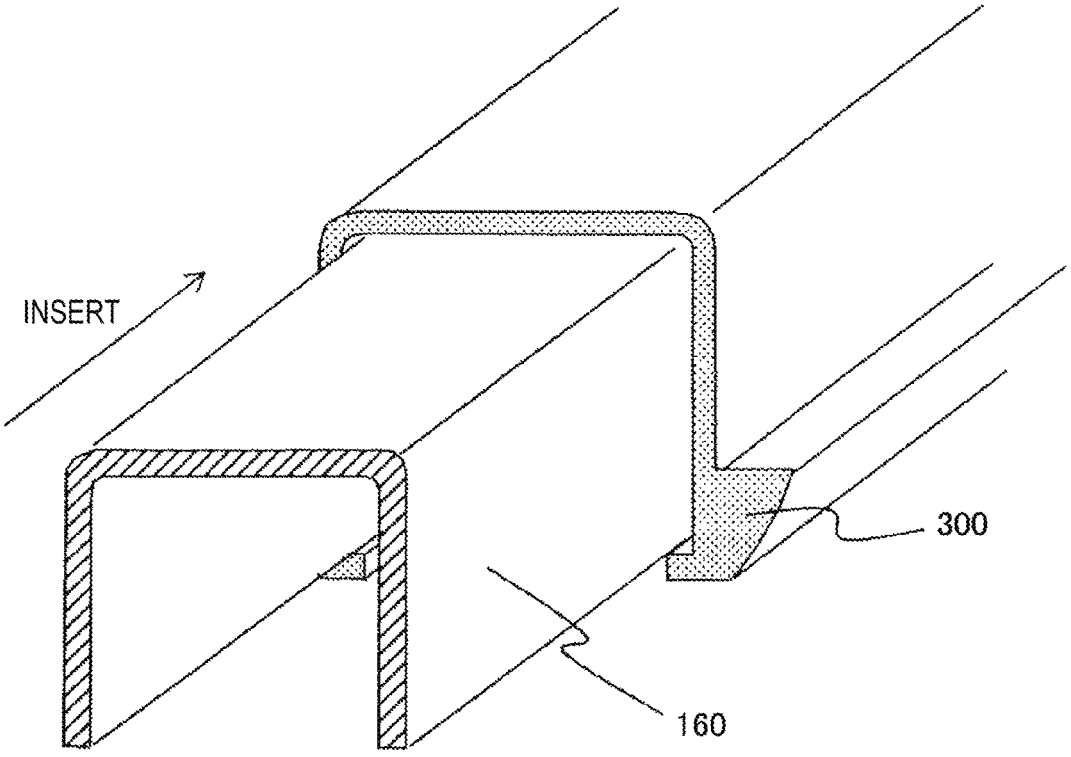
FIG. 8 is a view illustrating a method of integrating a belt guide member and a stay.

The following describes an embodiment of the present aspect with reference to FIGS. 7 and 8. In the present aspect, the configurations the same as those of the first embodiment described above are denoted with the same reference signs. The description of the configurations and functions similar to those of the first embodiment will be omitted, and characteristic portions of an embodiment of the present aspect will be described.

FIG. 7 is a cross-sectional view of an image heating apparatus 200 according to the second aspect. A stay 160 is a horizontally long member having rigidity by bending a sheet metal into a U-shape in cross section. The stay 160 is arranged so as to cover a reflection plate 140. A belt guide member 300 according to the second aspect is interposed between a thickness surface 162 of the stay 160 and the reflection plate 140. The belt guide member 300 supports and presses the reflection plate 140 and a nip plate 130, whereby a nip N is formed between a pressure roller 150 and a belt 110.

The belt guide member 300 according to the second embodiment is a heat-resistant resin member and configured to cover the stay 160. The belt guide member 300 is not in contact with an upper surface 165 of the stay 160, while a portion of an outer peripheral surface of the belt guide member 300 is configured to contact an inner surface of the belt 110 on the upstream side in the conveying direction.

As a result, while the image heating apparatus 200 is being driven, the position of the belt guide member 300 in the height direction is determined by the thickness surface 162 of the stay 160, and therefore a guide position contacting the inner surface of the belt 110 in the vicinity of the nip N is stabilized. Furthermore, since the belt guide member 300 is interposed between the thickness surface 162 of the stay 160 and the reflection plate 140, heat of the nip plate 130 is not directly transferred to the stay 160. Therefore, there are advantages in that the temperature rise in the stay 160 is suppressed, and at the same time, the belt guide member 300 is less likely to be affected by the dimensional change of the stay 160 due to heat.

An example of a method of pressing the belt guide member 300 by the stay 160 from an interior of the belt guide member 300 having such a cross-sectional shape is illustrated in FIG. 8. More specifically, the stay 160 is inserted into the belt guide member 300, which is fixed in advance, from the longitudinal direction of the belt guide member 300. After the belt guide member 300 and the stay 160 are integrated and mounted on the image heating apparatus 200, both ends of the stay 160 are pressed.

As described above, in an image heating apparatus in which a heat source is disposed inside a stay and a portion of an outer peripheral surface of a belt guide member contacts an inner surface of a belt, the belt guide member is engaged with the stay in the vicinity of a nip and supported by two or more surfaces of the stay. In this way, the belt guide position can be stabilized.

A back-up member 150 is not limited to a roller-shaped member according to the embodiments. For example, the back-up member 150 may include an endless belt and a pressing pad. Furthermore, an apparatus may also be configured such that a belt 110 is rotationally driven by a driving member other than the back-up member 150.

The image heating apparatus according to an embodiment of the present aspect is not limited to the use as a fixing device that fixes an unfixed toner image onto a sheet. The image heating apparatus can also be used as an image quality improving apparatus that increases the gloss by reheating a toner image temporarily or provisionally fixed on a sheet.

An image forming section of an image forming apparatus is not limited to that of an electrophotographic type, but may be of an electrostatic recording type or a magnetic recording type. Furthermore, the image forming section is not limited to that of a transferring type, but may be of a type that forms a toner image on a sheet in a direct manner.

While aspects of the present disclosure have been described with reference to exemplary embodiments, it is to be understood that the aspects of the present disclosure are not limited to the disclosed exemplary embodiments. The scope of the following claims is to be accorded the broadest interpretation so as to encompass all such modifications and equivalent structures and functions.

This application claims the benefit of Japanese Patent Application No. 2016-037121, filed Feb. 29, 2016, which is hereby incorporated by reference herein in its entirety.

What is claimed is:

1. A fixing apparatus that fixes an image onto a recording material, comprising:

a cylindrical belt;

a long narrow nip plate contacting an inner surface of the belt;

a roller configured to form a nip portion through the belt in conjunction with the nip plate;

a supporting member supporting the nip plate along a longitudinal direction of the nip plate, the supporting member having a cross section in a shape of U perpendicular to the longitudinal direction of the nip plate, and supporting, with two legs forming an opening in the shape of U, a surface of the nip plate opposite to a surface contacting the belt; and a guide member disposed on an upstream side of the nip plate in a recording material conveying direction in the nip portion and including a guide portion configured to contact the inner surface of the belt, wherein the recording material on which the image is formed is heated while being conveyed through the nip portion, and the image is fixed onto the recording material, wherein the supporting member is arranged such that the opening in the shape of U opens towards the nip plate, wherein the guide member is supported by a first surface and a second surface of an upstream side leg, among the two legs of the supporting member, located on an upstream side in the recording material conveying direction, and wherein the first surface is an end surface of the upstream side leg, and the second surface is a side surface of the upstream side leg and facing the inner surface of the belt.

2. The fixing apparatus according to claim 1, wherein the guide member is also supported by a third surface opposite to the second surface of the upstream side leg of the supporting member.

3. The fixing apparatus according to claim 1, wherein in a case where the guide member serves as a first guide member, the fixing apparatus includes a second guide member disposed on a downstream side of the nip plate in the recording material conveying direction and configured to contact the inner surface of the belt, the second guide member being a member independent of the first guide member.

4. The fixing apparatus according to claim 1, wherein in a case where the guide portion serves as a first guide portion, the guide member includes a second guide portion disposed on a downstream side of the nip plate in the recording material conveying direction, and configured to contact the inner surface of the belt, and wherein the first guide portion and the second guide portion of the guide member are connected through a connecting portion disposed outside a portion of the supporting member farthest from the opening of the supporting member in the cross section perpendicular to the longitudinal direction of the nip plate.

5. The fixing apparatus according to claim 1, further comprising:

a heater configured to heat the nip plate by radiation heat, wherein the heater is disposed in an area surrounded by the supporting member and the nip plate, when viewed in the longitudinal direction of the nip plate.

6. The fixing apparatus according to claim 5, further comprising:

a reflection member configured to reflect the radiation heat of the heater toward the nip plate, and disposed so as to surround the heater in the area surrounded by the supporting member and the nip plate, when viewed in the longitudinal direction of the nip plate.

7. A fixing apparatus that fixes an image onto a recording material, the fixing apparatus comprising:

a cylindrical belt;

a long narrow nip plate contacting an inner surface of the belt;

a roller configured to form a nip portion through the belt in conjunction with the nip plate;

a supporting member supporting the nip plate along a longitudinal direction of the nip plate, the supporting member having a cross section in a shape of U perpendicular to the longitudinal direction of the nip plate, and supporting, with two legs forming an opening in the shape of U, a surface of the nip plate opposite to a surface contacting the belt; and a guide member disposed on an upstream side of the nip plate in a recording material conveying direction in the nip portion and including a guide portion configured to contact the inner surface of the belt, wherein the recording material on which the image is formed is heated while being conveyed through the nip portion, and the image is fixed onto the recording material, wherein the supporting member is arranged such that the opening in the shape of U opens towards the nip plate, and wherein the guide member includes a recess, and a position of the guide member with respect to the supporting member in the recording material conveying direction is determined by fitting, among the two legs of the supporting member, an upstream side leg on an upstream side in the recording material conveying direction into the recess.

8. The fixing apparatus according to claim 7, wherein in a case where the guide member serves as a first guide member, the fixing apparatus includes a second guide member disposed on a downstream side of the nip plate in the recording material conveying direction and configured to contact the inner surface of the belt, the second guide member being a member independent of the first guide member.

9. The fixing apparatus according to claim 7, wherein in a case where the guide portion serves as a first guide portion, the guide member includes a second guide portion disposed on a downstream side of the nip plate in the recording material conveying direction, and configured to contact the inner surface of the belt, and wherein the first guide portion and the second guide portion of the guide member are connected through a connecting portion disposed outside a portion of the supporting member farthest from the opening of the supporting member in the cross section perpendicular to the longitudinal direction of the nip plate.

10. The fixing apparatus according to claim 7, further comprising:

a heater configured to heat the nip plate by radiation heat, wherein the heater is disposed in an area surrounded by the supporting member and the nip plate, when viewed in the longitudinal direction of the nip plate.

11. The fixing apparatus according to claim 10, further comprising:

a reflection member configured to reflect the radiation heat of the heater toward the nip plate, and disposed so as to surround the heater in the area surrounded by the supporting member and the nip plate, when viewed in the longitudinal direction of the nip plate.

* * * * *